United States Patent [19]

Hahm

[11] Patent Number: 4,902,609

[45] Date of Patent: Feb. 20, 1990

[54] PHOTOGRAPHIC PRINT MATERIAL WITH INCREASED EXPOSURE LATITUDE

[75] Inventor: Paul T. Hahm, Hilton, N.Y.

[73] Assignee: Eastman Kodak Company, Rochester, N.Y.

[21] Appl. No.: 87,276

[22] Filed: Aug. 20, 1987

[51] Int. Cl.[4] ..... G03C 7/20

[52] U.S. Cl. ..... 430/504; 430/505; 430/506

[58] Field of Search ..... 430/504, 505, 506

[56] References Cited

U.S. PATENT DOCUMENTS

| | | | |
|---|---|---|---|
| 3,497,350 | 2/1970 | Yutzy et al. | 430/505 |
| 3,663,228 | 5/1972 | Wyckoff | 430/506 |
| 4,485,627 | 12/1969 | Hellmig | 96/9 |
| 4,647,527 | 3/1987 | Ikenoue et al. | 430/506 |
| 4,707,436 | 11/1987 | Sasaki | 430/506 |
| 4,770,980 | 9/1988 | Matejec et al. | 430/504 |
| 4,806,460 | 2/1989 | Ogawa | 430/504 |

FOREIGN PATENT DOCUMENTS 3621764 1/1988 Fed. Rep. of Germany .

*Primary Examiner*—Richard L. Schilling
*Attorney, Agent, or Firm*—Joshua G. Levitt

[57] ABSTRACT

A multilayer color positive photographic print material with extended exposure latitude contains a limited amount of a spectral sensitizing dye for a first region of the spectrum in a silver halide emulsion layer spectrally sensitized to a second region of the spectrum.

7 Claims, No Drawings

PHOTOGRAPHIC PRINT MATERIAL WITH INCREASED EXPOSURE LATITUDE

FIELD OF THE INVENTION

This invention relates to color photography and materials for use therein. In a particular aspect it relates to a color positive photographic material with extended exposure latitude which yields an image viewable directly.

BACKGROUND OF THE INVENTION

Color positive photographic prints intended for direct viewing are typically made by imagewise exposing a support coated with layers sensitive to each of the blue, green, and red regions of the visible spectrum which yield yellow, magenta and cyan dye images, respectively. Exposure is commonly to a color negative film which contains a negative image of the original scene. If the exposure latitufe of the color print material is less than the full range of densities recorded in the film, reproduction of detail in the print will be poor.

Exposure latitude is a measure of the ability of a recording material to represent differences in intensity of exposure by differences in density. Thus, materials with a wide exposure latitude would respond to a wide range of exposure intensities by showing differences in image density, while materials with a narrow exposure latitude would for the same range of exposure intensities show fewer differences in density. Heretofore exposure latitude typically has been modified by manipulation of the silver halide emulsion. For example, increasing the range of grain sizes in an emulsion is known to extend the exposure latitude while narrowing the range of grain sizes is known to decrease exposure latitude. U.S. Pat. No. 3,663,228, issued May 16, 1972, to C. W. Wyckoff, discloses still other techniques for extending the exposure latitude in color photographic recording materials.

SUMMARY OF THE INVENTION

I have found a novel technique for extending the exposure latitude of color positive photographic materials in order to provide good reproduction of detail in the high-density regions of print materials.

In accordance with my invention, there is provided a color positive photograhic material comprising a support and first and second silver halide emulsion layers, each of which is sensitive to a given region of the electromagnetic spectrum and each containing a dye forming coupler, wherein the first emulsion layer is sensitized to the first region of the spectrum and the second silver halide emulsion layer is sensitized to the second region of the spectrum and to a limited extend to the first region of the spectrum.

In a particular embodiment of this invention, a small amount of green spectral sensitizing dye is added to the red sensitized emulsion layer. This has the effect of extending the exposure latitude of the green-sensitive layer by the formation of a small amount of additional cyan image dye in the red-sensitive layer as a function of green exposure of that layer. The addition of the density resulting from this cyan image dye to the magenta image dye density formed as the normal result of green exposure leads to an enhancement of observable detail in the high-density regions of the cyan image in the initially red-sensitive layer. Similar improvements in green detail can be obtained by spectrally sensitizing the green-sensitive layer to red light.

The amount of sensitizing dye added will depend upon balancing the amount of exposure latitude increase against the degree of the change in color rendition that is desirable or acceptable. Typically in the high density regions of an image, a change in color rendition is not a problem and is perceived as a detail enhancing shadow. Useful effects are obtained when as much as 30% by weight of the normal amount of sensitizing dye present in the first sensitized emulsion is added to the second sensitized emulsion. A preferred range of such dye addition extends from 5 to 15% by weight. The preferred level is chosen so as to maintain an appropriate degree of speed separation in the common region of the spectrum between the first and second emulsions. Such speed separation ranges generally are from 0.5 to 2.0, and preferably are from 0.85 to 1.30 log exposure units.

Spectral sensitizing dyes for use in the red- and green-sensitive emulsion layers include the classes of polymethine dyes referred to in, e.g., *Research Disclosure,* Dec. 1978, Item 17643, published by Emsworth Studios Inc., New York, N.Y. If additional sensitization of the blue-sensitive emulsion layer is desired, useful sensitizing dyes for use in this region of the spectrum include those described on pages 25 to 28 of Research Disclosure, January 1983, Item 22543.

One or more spectral sensitizing dyes may be used. Dyes with sensitizing maxima at wavelengths throughout the visible spectrum and with a great variety of spectral sensitivity curve shapes are known. The choice and relative proportions of dyes depends on the region of the spectrum to which sensitivity is desired and upon the shape of the spectral sensitivity curve desired. Dyes with overlapping spectral sensitivity curves will often yield in combination a curve in which the sensitivity at each wavelenth in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be employed for supersensitization are discussed by Gilman, "Review of the Mechanisms of Supersensitization", Photographic Science and Engineering, Vol. 18, 1974, pp. 418–430.

Any conventional silver halide emulsion containing a dye adsorbed to the surface of the silver halide grains can be employed. For color print applications silver chloride, silver bromide, and silver chlorobromide emulsions are commonly employed.

The silver halide emulsions employed in positive print materials are in most applications negative-working. Illustrative silver halide emulsion types and preparations are disclosed in *Research Disclosure,* Vol. 176, January 1978, Item 17643, Paragraph I.

Particularly preferred silver halide emulsions are high aspect ratio tabular grain emulsions, such as those described in Research Disclosure, Vol. 22534, cited above.

The photographic elements can be comprised of any conventional photograhic support. Typical photographic supports include, wood fiber—e.g., paper, metallic sheet and foil, glass and ceramic supporting elements provided with one or more subbing layers to enhance the adhesive, antistatic, dimensional, abrasive, hardness, frictional, antihalation, or other properties of the support surfaces. Typical useful supports are further disclosed in *Research Disclosure,* Item 17643, cited above, Paragrach XVII.

In addition to the features described above the photographic elements can, of course, contain other conventional features known in the art, which can be illustrated by reference to *Research Disclosure,* Item 17643, cited above. For example, the silver halide emulsions can be chemically sensitized, as described in Paragraph III; contain brighteners, as described in Paragraph V; contain antifoggants and stabilizers, as described in Paragraph VI; absorbing and scattering materials, as described in Paragraph III, the emulsion and other layers can contain vehicles, as described in Paragraph IX; the hydrophilic colloid and other hydrophilic colloid layers can contain hardeners, as described in Paragraph X; the layers can contain coating aids, as described in Paragraph XI; the layers can contain plasticixers and lubricants, as described in Paragraph XII; and the layers, particularly the layers farthest from the support, can contain matting agents, as described in Paragraph XVI. This exemplary listing of addenda and features is not intended to restrict or imply the absence of other conventional photographic features compatible with the practice of the invention.

The photographic elements intended to produce viewable dye images need not incorporate dye image providing compounds, such as couplers, as initially prepared, since processing techniques for introducing such compounds after imagewise exposure and during processing are well known in the art. However, to simplify processing and in the case of the production of paper prints for viewing by reflection, it is common practice to incorporate image dye providing compounds in photographic elements prior to processing, and such photographic elements are specifically contemplated in the practice of this invention. The photographic elements can form dye images through the selective destruction, formation, or physical removal of incorporated image dye providing compounds.

The photographic elements within the scope of this invention preferably include those wherein dye images are produced through the selective formation of dyes, such as by reacting (coupling) a color developing agent (e.g., a primary aromatic amine) in its oxidized form with a dye-forming coupler. In one form the dye-forming couplers are chosen to form subtractive primary (i.e., yellow, magenta and cyan) image dyes and are nondiffusible, colorless compounds, such as two- and four-equivalent couplers of the open chain ketomethylene, pyrazolone, pyrazolotriazole, pyrazolobebzimidazole, phenol and naphthol type hydrophobically ballasted for incorporation in high-boiling organic (coupler) solvents. Suitable types and classes of couplers, as well as methods for their incorporation in color photograhic materials are described in *Research Disclosure,* Item 17643, December 1978, Section VII, Paragraphs C, D, E, F, and G, incorporated herein by reference.

Following imagewise exposure, multilayer color photographic elements of the type used in this invention can be processed by any conventional technique of producing a dye image by color development, whereafter the concurrently generated silver is removed by bleaching. Residual, undeveloped silver halide can be removed in a separate fixing step or concurrently with bleaching. A separate pH lowering solution, referred to as a stop bath, may be employed to terminate development prior to bleaching. A stabilizer bath is commonly employed for final washing and hardening of the bleached and fixed photographic element prior to drying. Conventional techniques for processing are illustrated by *Research Disclosure,* Item 17643, cited above, Paragraph XIX.

The following examples further illustrate this invention.

EXAMPLE 1

A control color photographic material was prepared by coating the following layers in sequence on a polyethylene laminated paper support. Except as noted all coverages in parenthesis are in g/m2.

| | |
|---|---|
| Layer 7 | Gelatin (1.35) |
| Layer 6 | Gelatin (0.69) - UV-absorber (0.38) |
| Layer 5 | Chemically sensitized monodisperse silver chloride emulsion, average grain diameter 0.48 um silver coverage (0.23), gelatin coverage (1.08), containing the red sensitizing dye R* (16 mg/Ag mole), and the cyan dye forming coupler C* (0.43) |
| Layer 4 | Gelatin (0.69) - UV-absorber (0.38) |
| Layer 3 | Chemically sensitized monodisperse silver chloride emulsion, average grain diameter 0.38 um, silver coverage (0.32), gelatin coverage (1,23), containing the green sensitizing dye G* (330 m/g mole), and the magenta dye forming coupler M* (0.48) |
| Layer 2 | Gelatin (1.50) |
| Layer 1 | Chemically sensitized and blue spectrally sensitized monodisperse silver chloride emulsion, average grain diameter 0.8 um, silver coverage (0.42), gelatin coverage (1.50), containing the yellow dye forming coupler Y* (1.08) |
| Support | Polyethylene coated paper |

*R = Red spectral sensitizing dye anhydro-3-ethyl-9,11-neopentylene-3'-(3-sulfopropyl)thiadicabo-cyanine hydroxide G = Green spectral sens. dye anhydro-5-chloro-9-ethyl-5'-phenyl-3'-(3-sulfobutyl)-3-(3-sulfo-propyl)oxacarbocyanine hydroxide, sodium salt C = Cyan dye forming coupler 2-[α-(2,4-di-tert-amylphenoxy)butramido]-4,6-dichloro-5-ethyl phenol M = Magenta dye forming coupler 1-(2,4,6-trichloro-phenyl)-3-[2-chloro-5-(α-{4-hydroxy-3-tert-butyl-phenoxy}tetradecanoamido)anilino]-5-pyrazolone Y = Yellow dye forming coupler α[4-(4-benzyloxy-phenylsulfonyl)phenoxy]-α-pivalyl-2-chloro-5-[α-butyramido]-acetanilide A color photographic material according to this invention was prepared. It differed from the one described above only in that the red-sensitive emulsion layer was additionally sensitized with 33 mg/Ag mole of the green sensitizing dye G.

Each of these photographic materials was imagewise exposed through a graduated neutral-density, Status A color separation test object and then processed at 35° C. in a three-step process consisting of a 45 second development step, a 45 second bleach-fix step, and a 90 second stabilizing step, followed by a one-minute drying step at a temperature of 60° C.

The color developing, bleach-fixing and stabilizing compositions used in the process were as follows:

| COLOR DEVELOPING COMPOSITION | |
|---|---|
| Lithium salt of sulfonated polystyrene | 0.25 ml |
| Triethanolamine | 11.0 ml |
| N,N—diethylhydroxylamine | 6.0 ml |
| Potassium sulfite | 0.5 ml |
| Color developing agent* | 5.0 g |
| Stain reducing agent** | 2.3 g |
| Potassium chloride | 2.3 g |
| EDTA ($2Na.H_2O$) | 3.0 g |
| 3,4-dihydroxy-1,2,5-benzenetrisulfonic acid trisodium salt | 0.6 g |
| Potassium carbonate | 25.0 g |
| Water to total of 1 liter | (pH 10.04) |

*4-(N—ethyl-N—2-methanesulfonylaminoethyl)-2-methyl-phenylenediamineses-quisulfate monohydrate.
**A stilbene compound available under the trademark KODAK EKTAPRINT 2 Stain-Reducing Agent from Eastman Kodak Company.

Bleach-Fixing Composition

The bleach-fixing composition had a pH of 6.2 and was comprised of ammonium thiosulfate, sodium bisulfite, and an ammonium salt of the ferric complex of ethylenediaminetetraacetic acid.

Stabilizing Composition

The stabilizing composition had a pH of 7.2 and was comprised of formaldehyde, sodium metabisulfite, potassium hydroxide, diethylene glycol, 5-chloro-2-methyl-4-isothiazolin-3-one, the disodium salt of ehtylenediamine-tetraacetic acid, and 1-hydroxyethylidene-1,1-diphosphonic acid.

The control material developed 11 visible steps while the invention material developed 15 visible steps. More than 15 steps could be seen in the invention material when the green exposure was increased. All steps above Dmin were visible.

This leads to the conclusion that the invention material has an extended exposure latitude compared with the control material and can record more detail in high-density regions of the image.

If this example were repeated using 1-(2,4,6-trichlorophenyl)-3-(2-chloro-5-tetradecanamido)anilino-4-(2-pivalamido)phenylthio-2-pyrazolin-5-one as the magenta dye forming coupler in both the control and invention materials, the material of the invention material would provide both an extension of exposure latitude compared to the control material and a magenta image which is desirably more bathochromic in hue compared to the hue of the magenta image in the control material.

EXAMPLE 2

The color photographic print materials of Example 1 were imagewise exposed to a color negative image and processed as in Example 1. Visual inspection of the resulting print showed significantly greater detail in the image on the print material of the invention.

Although the invention has been described in detail with particular reference to preferred embodiments thereof, it will be understood that variations and modifications can be effected within the spirit and scope of the invention.

What is claimed is:

1. A photographic print material for forming a positive multicolor dye image comprised of a paper support, a blue-sensitive, yellow-dye-image-forming silver halide emulsion layer, a green-sensitized, magenta-dye-image-forming silver halide emulsion layer, and a red-sensitized, cyan-dye-image-forming silver halide emulsion layer, wherein the green-sensitized emulsion layer contains the red-sensitizing dye anhydro-3-ethyl-9,11-neopentylene-3'-(3-sulfopropyl)-thiadicarbocyanine hydroxide in an amount of from 5 to 15% by weight of the amount of red-sensitizing dye contained in the red-sensitized emulsion layer.

2. A photographic print material for forming a positive multicolor dye image comprised of a paper support, a blue-sensitive, yellow-dye-image-forming silver halide emulsion layer, a green-sensitized, magenta-dye-image-forming silver halide emulsion layer, and a red-sensitized, cyan-dye-image-forming silver halide emulsion layer, wherein the red sensitized emulsion layer contains the green sensitizing anhydro-5-chloro-9-ethyl-5'-phenyl-3'-(3-sulfobutyl)-3-(3-sulfopropyl)-oxacarbocyanine hydroxide, sodium salt in an amount from 5 to 15% by weight of the amount of green sensitizing dye contained in the green sensitized emulsion layer.

3. A photographic print material for forming a positive multicolor dye image comprised of a paper support, a yellow-dye-image-forming silver halide emulsion layer having its principal sensitivity in the blue region of the spectrum, a magenta dye-image-forming silver halide emulsion layer having its principal sensitivity in the green region of the spectrum, and a cyan dye-image-forming silver halide emulsion layer having its principal sensitivity in the red region of the spectrum.

wherein (a) at least one of the magenta and cyan dye-forming emulsion layers contains an amount of the spectral sensitizing dye employed to provide principal sensitivity to the other of the magenta and cyan dye-forming emulsion layers sufficient to provide that layer with a secondary sensitivity to the region of the spectrum to which the other of the layer has its principal sensitivity.

(b) there is a speed separation between the two said emulsion layers in that common region of sensitivity of between about 0.85 and 1.30 log E, and (c) the dye that provides principal and secondary sensitivity to the green region of the spectrum is anhydro-5-chloro-9-ethyl-5'-phenyl-3'-(3-sulfobutyl)-3-(sulfopropyl)-oxacarbocyanine hydroxide, sodium salt and the dye that provides principal and secondary sensitivity to the red region of the spectrum is anhydro-3-ethyl-9,11-neopentylene-3'-(3-sulfopropyl)-thiadicarbocyanine hydroxide.

4. A photographic element according to claim 3 wherein the layer which has its principal sensitivity in the green region of the spectrum has a secondary sensitivity in the red region of the spectrum.

5. A photographic element of claim 3 wherein the layer which has its principal sensitivity in the red region of the spectrum has a secondary sensitivity in the green region of the spectrum.

6. A photographic element of any one of claims 1–5 wherein the magenta dye forming coupler is 1-(2,4,6-trichlorophenyl)-3-[(2-chloro-5-(α-{4-hydroxy-3-tert-butyl-phenoxy}tetradecanamido)-anilino]-5-pyrazolone and the cyan dye-forming coupler is 2-[α-(2,4-di-tert-amylphenoxy)butyramido]-4,6-dichloro-t-ethylphenol.

7. A photographic element of claims 1–5 wherein the magenta dye forming coupler is 1-(2,4,6-trichloro-phenyl)-3-(2-chloro-5-tetradecanamido)-anilino-4-(-2-pivalamido)phenylthio-2-pyrazolin-5-one and the cyan dye-forming coupler is 2-[α-(2,4-di-tertamylphenoxy)-butyramido]-4,6-dichloro-5-ethylphenol.

* * * * *